US010190835B2

(12) United States Patent
Hsu et al.

(10) Patent No.: US 10,190,835 B2
(45) Date of Patent: Jan. 29, 2019

(54) AMMUNITION MAGAZINE BASEPAD EXTENSION

(71) Applicant: ZEV Technologies, Inc., Oxnard, CA (US)

(72) Inventors: Sheehan Hsu, Oxnard, CA (US); Alec Wolf, Westlake Village, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 15/996,639

(22) Filed: Jun. 4, 2018

(65) Prior Publication Data

US 2018/0347929 A1 Dec. 6, 2018

Related U.S. Application Data

(60) Provisional application No. 62/514,231, filed on Jun. 2, 2017.

(51) Int. Cl.
*F41A 9/71* (2006.01)
*F41A 9/72* (2006.01)

(52) U.S. Cl.
CPC . *F41A 9/71* (2013.01); *F41A 9/72* (2013.01)

(58) Field of Classification Search
CPC ..... F41A 9/71; F41A 9/68; F41A 9/72
See application file for complete search history.

(56) References Cited

U.S. PATENT DOCUMENTS

| | | | | |
|---|---|---|---|---|
| 4,831,761 | A | 5/1989 | Kulakow | |
| 5,438,783 | A | 8/1995 | Sniezak et al. | |
| 5,642,582 | A | 7/1997 | Grams | |
| 5,666,752 | A | 9/1997 | Grams | |
| 6,557,287 | B2 | 5/2003 | Wollmann | |
| 7,093,386 | B1 | 8/2006 | Vieweg | |
| 7,117,622 | B2 | 10/2006 | Freed et al. | |
| 7,509,767 | B2 | 3/2009 | Bolen | |
| 8,863,423 | B2 | 10/2014 | Clifton, Jr. et al. | |
| 8,925,231 | B2 | 1/2015 | Lee | |
| 9,772,151 | B1 | 9/2017 | Sanderson et al. | |
| 2002/0029506 | A1* | 3/2002 | Wollmann | F41A 9/65 42/50 |
| 2017/0321979 | A1* | 11/2017 | Szczepkowski | F41A 9/71 |
| 2018/0031342 | A1* | 2/2018 | Faifer | F41A 9/71 |

FOREIGN PATENT DOCUMENTS

| | | | | |
|---|---|---|---|---|
| DE | 4432192 | C1 * | 3/1996 | F41A 9/71 |

* cited by examiner

*Primary Examiner* — Stephen Johnson
(74) *Attorney, Agent, or Firm* — Wood Herron & Evans LLP

(57) ABSTRACT

A magazine extension for attachment to an open bottom of a magazine tube having a pair of sidewalls, a pair of end walls, and a flange on at least each of the sidewalls at the bottom. The extension includes an extension body having open first and second ends and forward and rear walls. The first open end of the extension body is slidably attachable to the sidewall flanges at the bottom end of a magazine tube. A bottom closure member is removably slidably attached to the open second end of the body and movable between open and closed positions. A latch member is slidably attached to a wall of the extension body to move toward and away from the magazine tube and open ends of the extension body. The latch member releasably secures the extension body to the magazine tube when moved toward the magazine tube and first open end of the extension body.

8 Claims, 8 Drawing Sheets

AMMUNITION MAGAZINE BASEPAD EXTENSION

RELATED APPLICATIONS

This application claims priority to U.S. Provisional Patent Application No. 62/514,231, filed Jun. 2, 2017, the entire contents of which are incorporated herein by reference.

TECHNICAL FIELD

The present invention relates to a basepad and extension adaptor for a removable box-type ammunition magazine. More particularity, it relates to such a device that is easily installed and allows removal of the magazine spring and follower without complete disassembly thereof.

BACKGROUND

It is known to use a basepad extension on a removable ammunition magazine, particularity for handguns, in order to increase the capacity of the magazine and/or to provide a handgrip portion that will extend beyond the handgun grip when installed. This allows better hand grasp on the magazine for rapid removal and insertion of magazines.

The OEM handgun magazine typically includes a tubular body with an open bottom end with a flange or rim extending from two or three edges of the open end. A standard baseplate or basepad typically is attached to the magazine body by sliding over this flanged rim. It is held in place either by an internal engagement pushed against the basepad by the magazine's spring or by another mechanical locking means. In many common handgun magazines, such as for the Glock™ pistol, the magazine body is made of a polymer material (or combination of polymer and steel), while the basepad extension is typically made of lightweight metal, such as an aluminum alloy. Many extended basepads include an integral floor or bottom wall that defines a closed cavity to receive the lower end of a follower spring. To remove the follower spring or access the interior of the magazine tube, the extended basepad must be removed from the magazine tube. These often require compression of the magazine's spring as the basepad extension is slid into an engagement with the magazine body. This can require a challenging level of manual dexterity or can result in damage to the magazine's spring as the basepad is slid into position orthogonal to the force of the spring.

Some engagement mechanisms utilize a metal pin, which concentrates force against a single point at the bottom end of the magazine tube. This can lead to the magazine tube deforming when dropped on a hard surface. When this happens, the basepad body disengages from the magazine body, often scattering the loaded rounds contained within the magazine. Other designs have complex assembly mechanisms or require the use of a tool for assembly or disassembly. Prior Basepad extensions having an openable bottom end may require the separation of multiple parts that can be dropped, misplaced, or lost.

SUMMARY OF THE INVENTION

Features of the present invention include a removable floor or bottom closure plate at the bottom of the basepad extension that slides between open and closed positions to allow insertion or removal of the follower and magazine spring without disassembly of the basepad extension from the magazine body. This allows easy assembly of the basepad extension to the magazine body without tools and without the magazine spring interfering with the assembly. Additionally, it allows removal of the magazine spring and follower for cleaning or maintaining the interior without disassembly of the basepad extension from the magazine body.

The present invention can also feature a captive floor or bottom closure plate, allowing the magazine to be opened for removal of the magazine spring and follower without removal/separation of the closure plate from the extension body, which could be dropped or lost.

On embodiment of the present invention also provides a multi-function locking mechanism or latch. This latch acts to retain the basepad extension to the magazine body, to maintain the floor or bottom closure plate in a closed position, and as a detent to retain the floor or closure plate when it is moved to an open position.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1A:
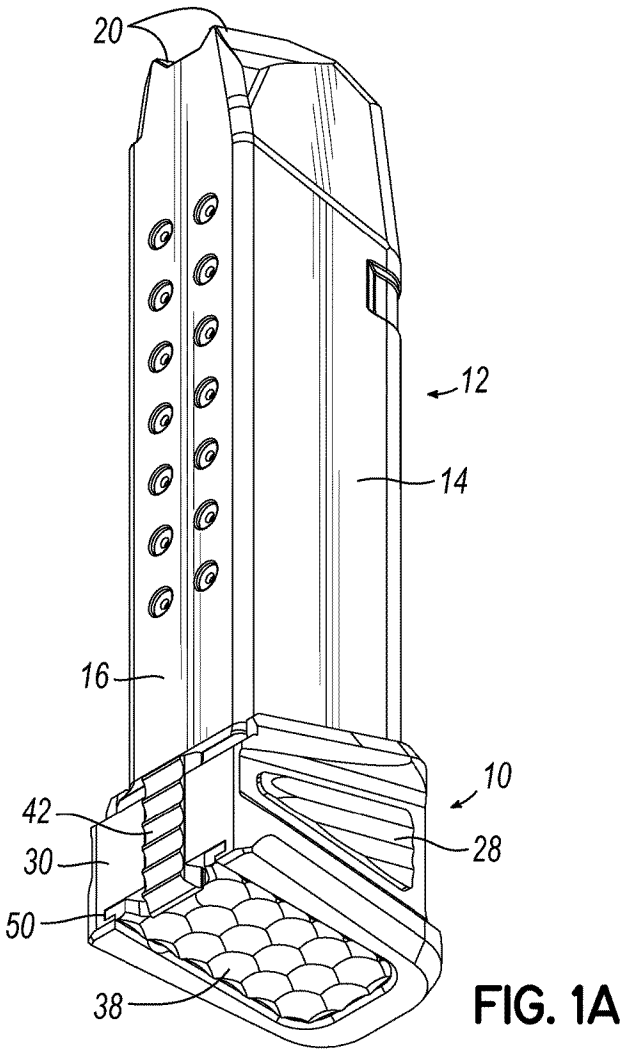
FIG. 1A is second isometric view thereof.
Figure 1:
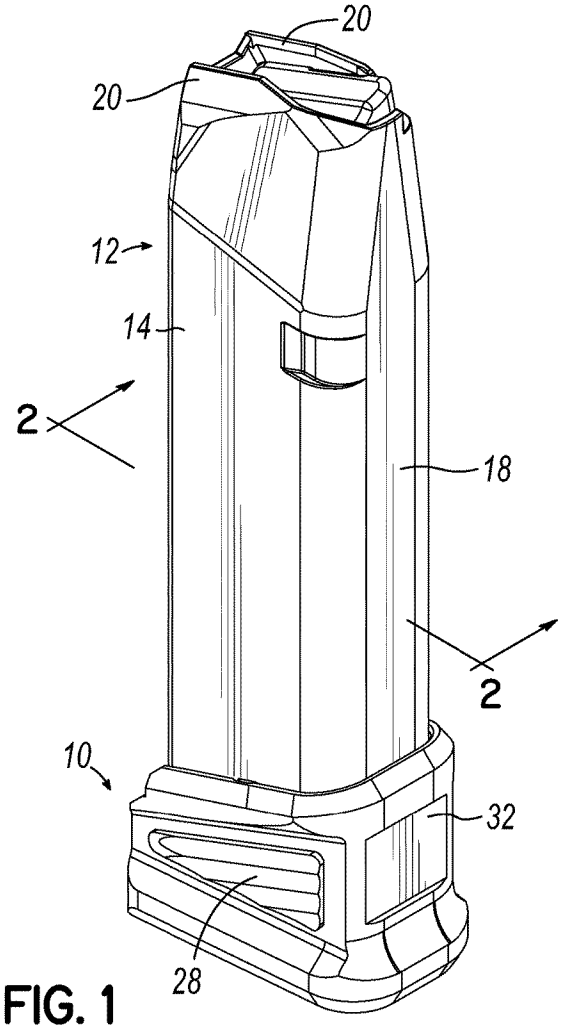
FIG. 1 is a first isometric view of a magazine basepad extension according to an embodiment of the invention installed on a magazine body.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIGS. 1-4, therein is shown a basepad extension 10 according to an embodiment of the present invention installed on an ammunition magazine body tube 12. The illustrated embodiment depicts a magazine body 12 designed for use with a Glock™ handgun (not shown), although it could be adapted to box-type magazines for other pistols and/or rifles. The magazine tube 12 is in the form of an elongated tube with laterally spaced apart sidewalls 14, a rear wall 16, and a forward wall 18. The tube 12 has open ends with feed lips 20 at the top end for delivering a cartridge (not shown) into the action of a firearm. The opposite (bottom) end may include a rim or outwardly projecting flange 22. The flange 22 typically projects from at least the side walls 14, but may also project from the front wall 18 (as illustrated) and/or rear wall 16. In a typical magazine of this type, a standard magazine floorplate (not shown) includes a channel that will slide on to the flange 22 and will remain secured by an internal magazine insert plate (not shown) biased into engaging position by the internal magazine spring. According to an embodiment of the present invention, the standard basepad (and insert plate) is replaced with a basepad extension 10. Replacement of the standard basepad with a basepad extension 10 that increases the ammunition capacity of the magazine usually includes replacement of the original feeding spring with a correspondingly longer coiled compression spring 24 that biases a follower 26 toward the upper end of the magazine tube 12, pushing ammunition cartridges (not shown) toward the feed lips 20.

Like other magazine extension devices, the basepad extension 10 of the present invention provides two main functions: to elongate the longitudinal dimension of the magazine tube 12 in order to increase its ammunition holding capacity, and to provide and enlarged and improved grip area for providing better hand grasps when removing and inserting magazines from the firearm magazine well or from a magazine holster.

The basepad extension 10 provides a tubular extension of the magazine tube 12 with interior surfaces that generally correspond to and align with interior surfaces of the side walls 14, rear walls 16, and forward wall 18. A typical handgun magazine tube 12 may have an open bottom end that is angled relative to the longitudinal axis of the magazine tube 12. This angle is due to handgun magazines typically being inserted into a magazine well located within a hand grip portion of the handgun, which is typically angled relative to vertical and not situated exactly perpendicular to the bore axis of the handgun barrel. The angled lower end of the magazine tube 12 allows it to conform to the angle at the heel end of the handgun grip where the magazine is inserted into the magazine well. The basepad extension 10 of the illustrated embodiment has a bottom end that is substantially perpendicular to the longitudinal axis of the magazine tube 12, allowing a loaded magazine to stand upright on a horizontal surface. This is not a necessary feature of the present invention, which could, if desired, provide a bottom that is substantially parallel to the bottom open end of the magazine tube 12, while exploiting the features and benefits of the invention.

Unlike some other magazine basepad extension devices, the present invention maybe installed on a magazine tube 12 prior to insertion of the spring 24 and follower 26. Likewise, it allows the spring 24 and follower 26 to be removed from the magazine tube 12 easily without disassembly of the basepad extension 10 from the magazine tube 12 for cleaning and/or lubrication.

Figure 5:
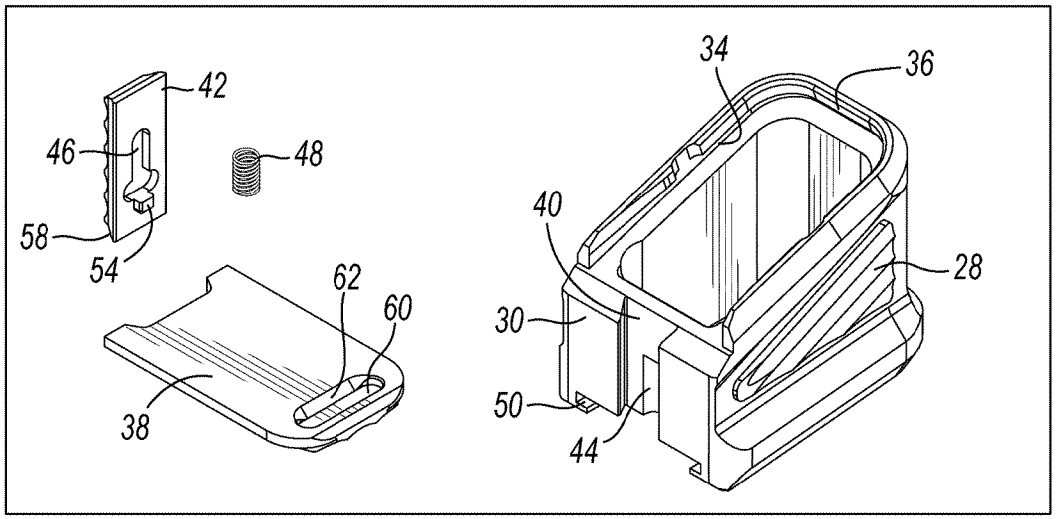
FIG. 5 is an exploded isometric view of the basepad extension parts.
Figure 6:
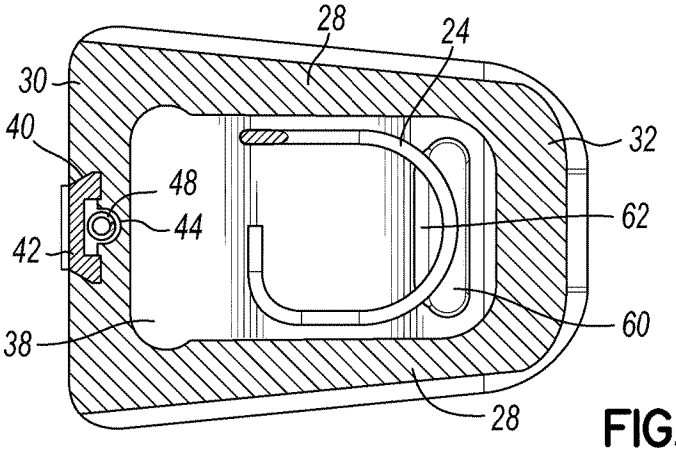
FIG. 6 is a top cross-sectional view taken substantially along line 6-6 of FIG. 3.
Figure 8:
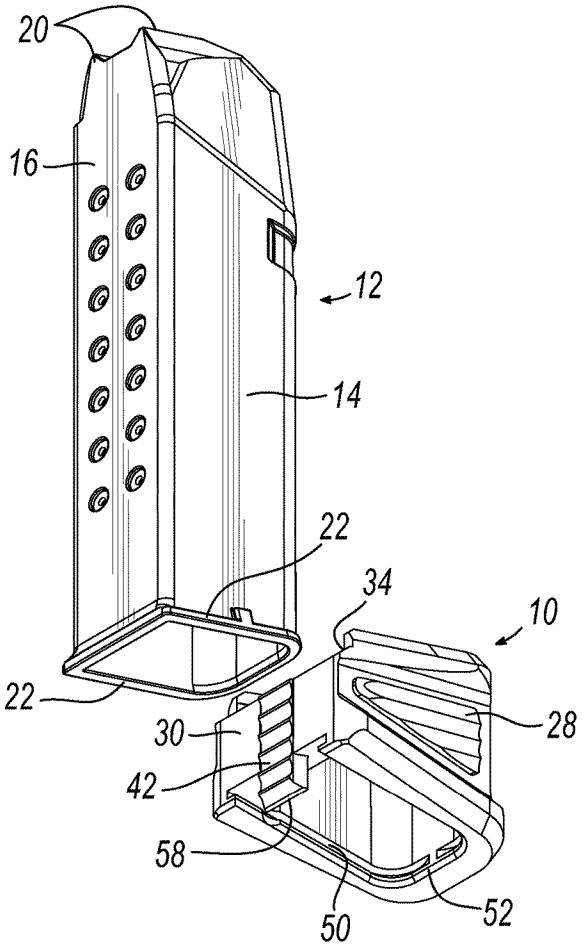
FIG. 8 is an isometric view showing a magazine basepad extension of the present invention being installed on a magazine body.
Figure 7:
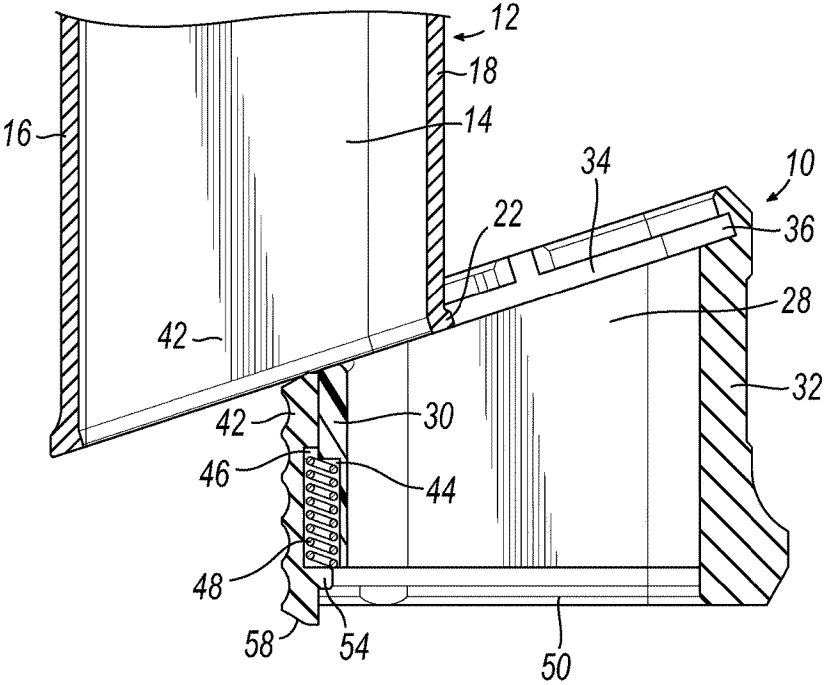
FIG. 7 is a fragmentary side sectional view showing a basepad extension according to an embodiment of the present invention being installed on the open end of a magazine body.

Referring now also to FIGS. 7 and 8, the basepad extension 10 may include laterally spaced apart sidewalls 28, a rear wall 30, and a forward wall 32 corresponding to the walls of the magazine tube 12 and providing corresponding interior surfaces that extend the tubular cavity of the magazine tube 12. The body of the basepad extension 10 can have open upper and lower ends. In the illustrated embodiment, the upper end includes side and forward attachment channels 34, 36 sized to slidingly receive the side and forward flanges 22 of the magazine body 12. A rear edge of the upper open end is open to receive the flanges 22 into the channels 34, 36, as shown in FIGS. 5 and 6. In other embodiments, the lower end of the magazine tube 12 may have flanges 22 on the sides and rear edge, such that the basepad extension 10 is slid into engagement from the rear and has an open front edge. As shown, the basepad extension 10 is installed on the magazine tube 12 prior to insertion of the magazine spring 24 and follower 26. Accordingly, the spring 24 does not interfere with sliding the basepad extension 10 over the bottom open end of the magazine tube 12.

Figure 9:
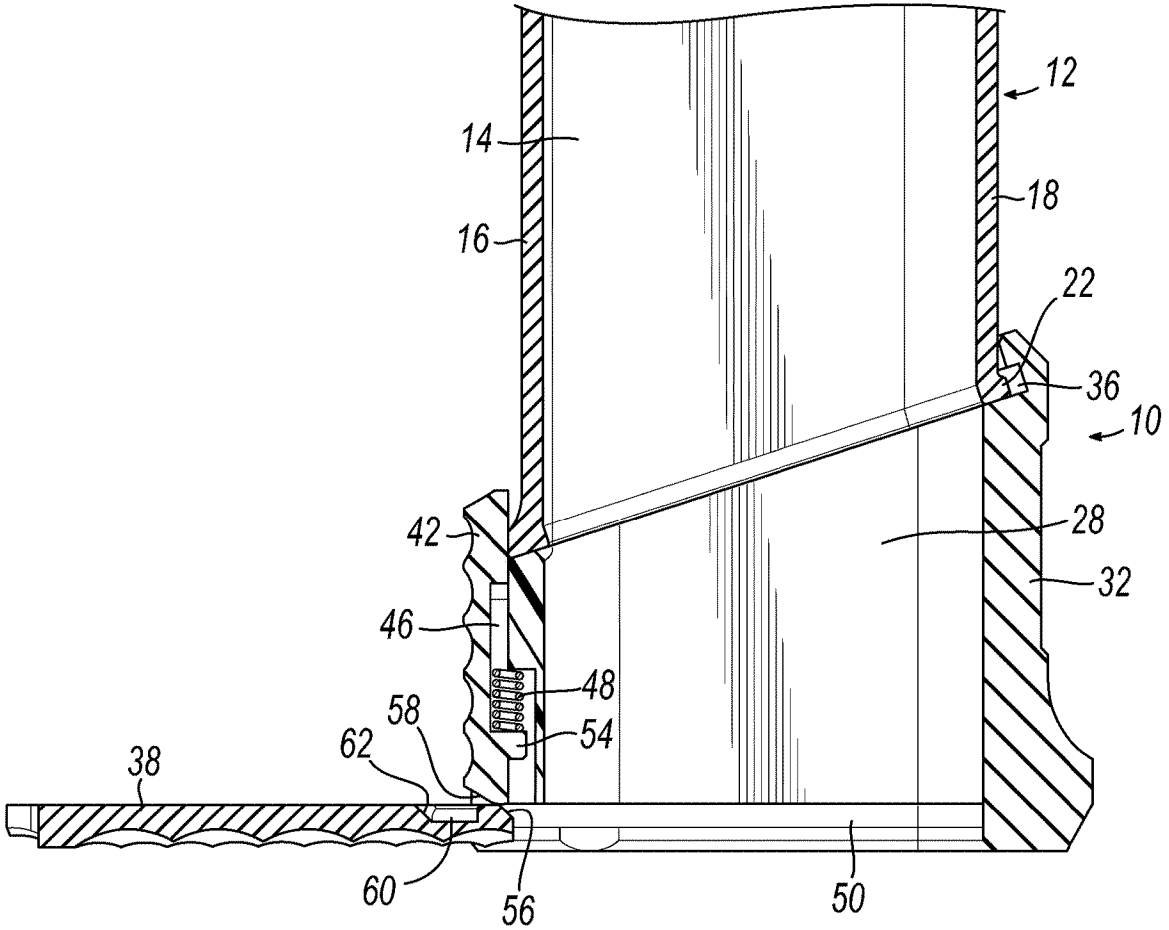
FIG. 9 is a fragmentary side sectional view showing a floorplate being installed thereon.

Referring now also to FIG. 9, a bottom closure sliding door or plate 38 is installed after the basepad extension 10 has been assembled to the magazine tube 12. The bottom closure plate 38 may be inserted and slidably received within side channels 50 and a forward channel 52 at the bottom end opening of the basepad extension 10. In FIGS. 5 and 6, it can be seen that the rear wall 30 of the basepad extension 10 includes a T-shaped or dovetail channel 40, which slidably receives a latch member 42. Alternatively, the latch member 42 can be situated to the rear of the rear wall 30 (or forward of front wall 32) and include a dovetail rail that slides in a dovetail channel 40. Or the latch member 42 can include an upper end claw (not shown) that extends outwardly and upwardly, if the rear wall 30 of the extension 10 is aligned flush with the rear wall 16 (or, alternatively, front wall 18) of the magazine tube 12. Within the channel 40 may be a recess 44 that aligns with a corresponding recess 46 in the latch member 42 to enclose and guide a latch spring 48.

Figure 3:
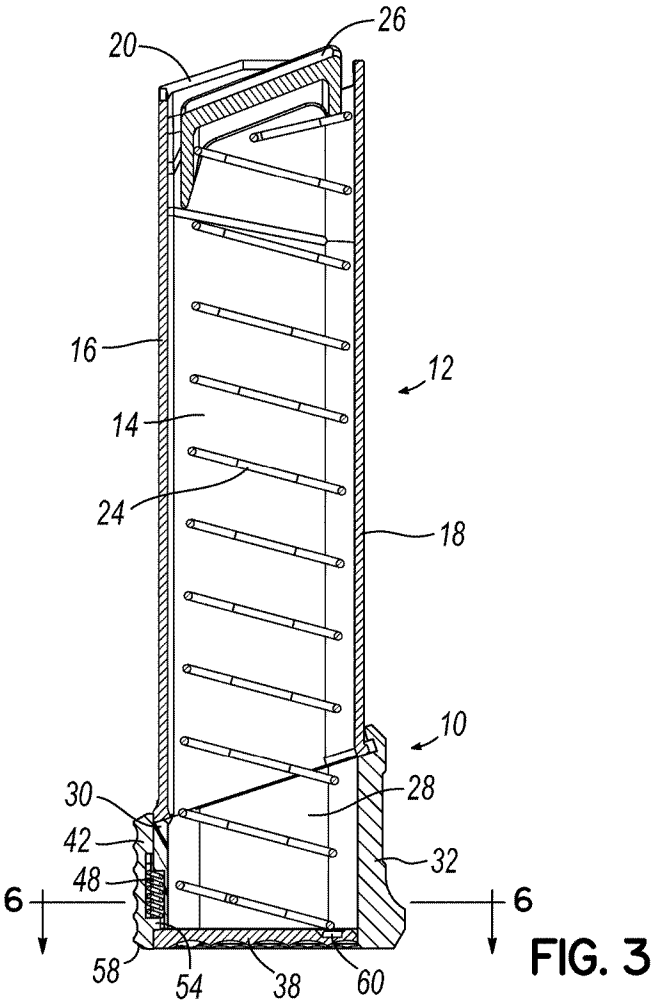
FIG. 3 is a side sectional view thereof.
Figure 2:
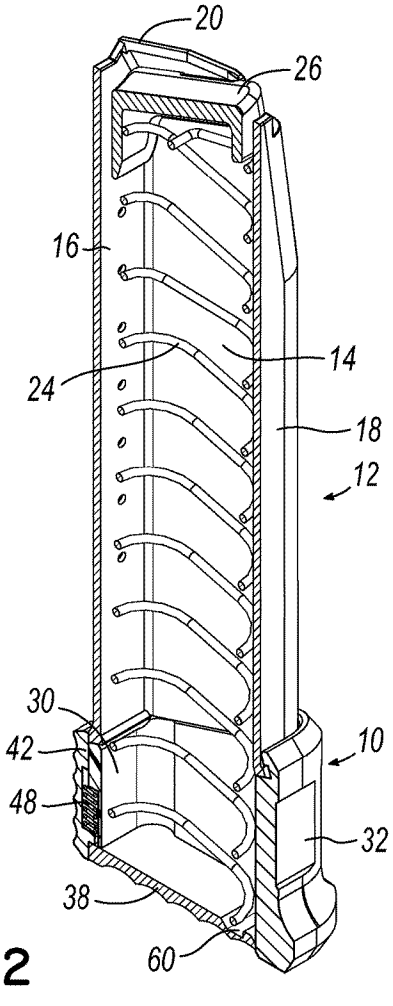
FIG. 2 is an isometric longitudinal sectional view thereof.
Figure 4:
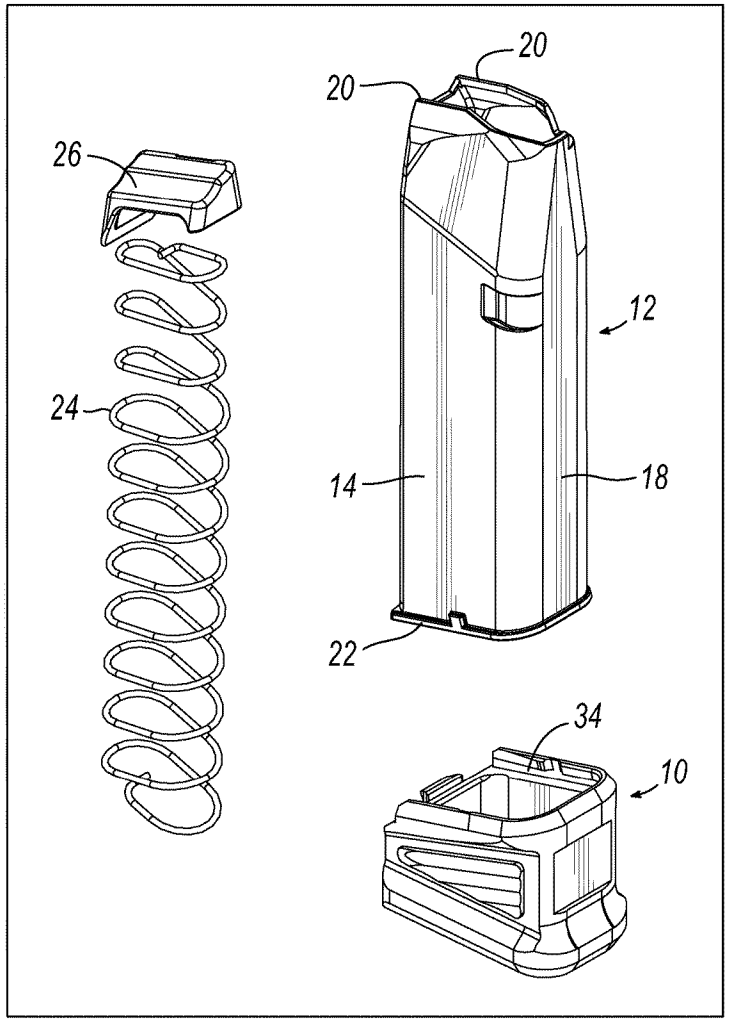
FIG. 4 is an isometric exploded view thereof.
Figure 11:
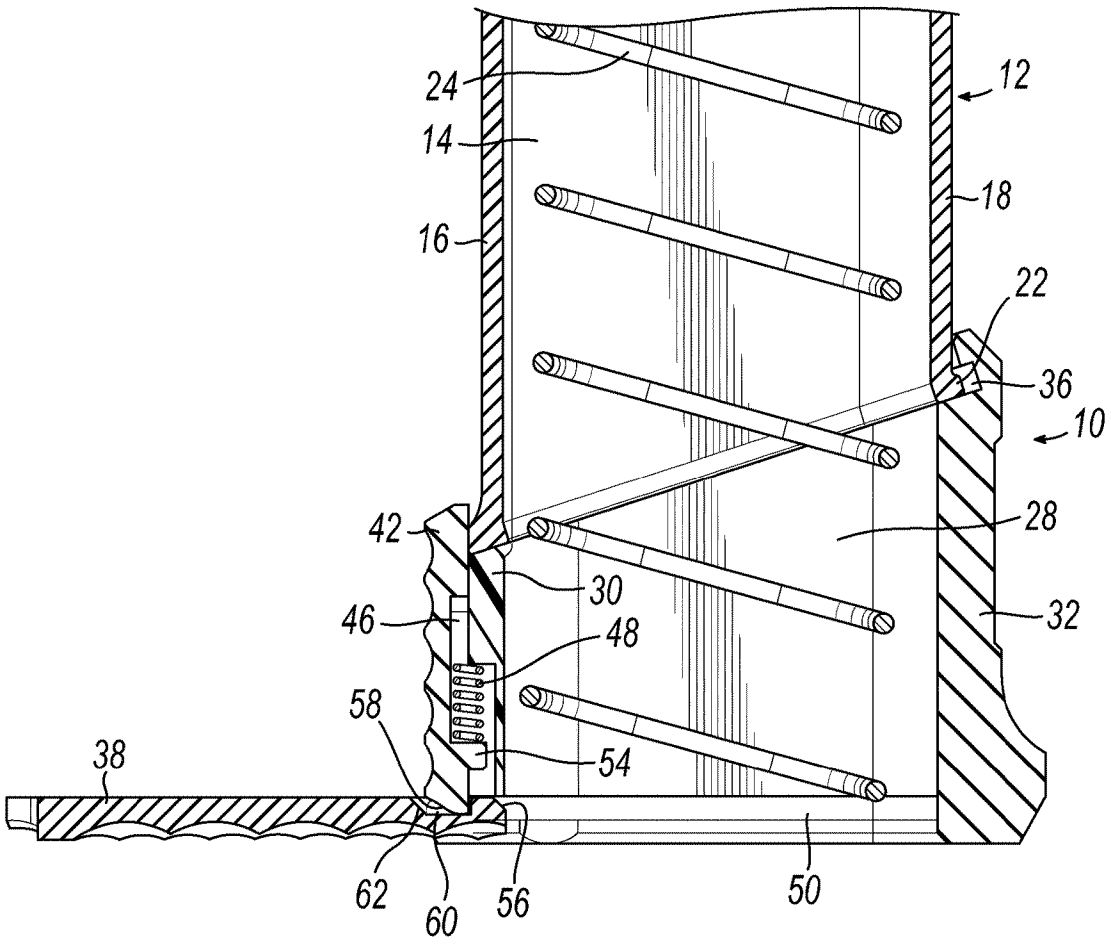
FIG. 11 is a fragmentary side sectional view showing the magazine spring installed and floorplate in an open position.

The latch member 42 can operate both to secure the basepad extension to the magazine tube 12 and to hold the bottom closure plate 38 in closed (FIGS. 1-3) and retained (FIG. 11) positions. The latch member 42 is in an "at rest" position when biased against the bottom closure plate 38 (FIGS. 2, 3, and 11). The latch member 42 can be moved against the spring 48 to insert/remove the bottom closure plate 38 (FIG. 9) or, when the bottom closure plate 38 is removed, it can be slid down to allow attachment/removal of the extension 10 from the magazine tube 12 (FIGS. 7 and 8).

Figure 10:
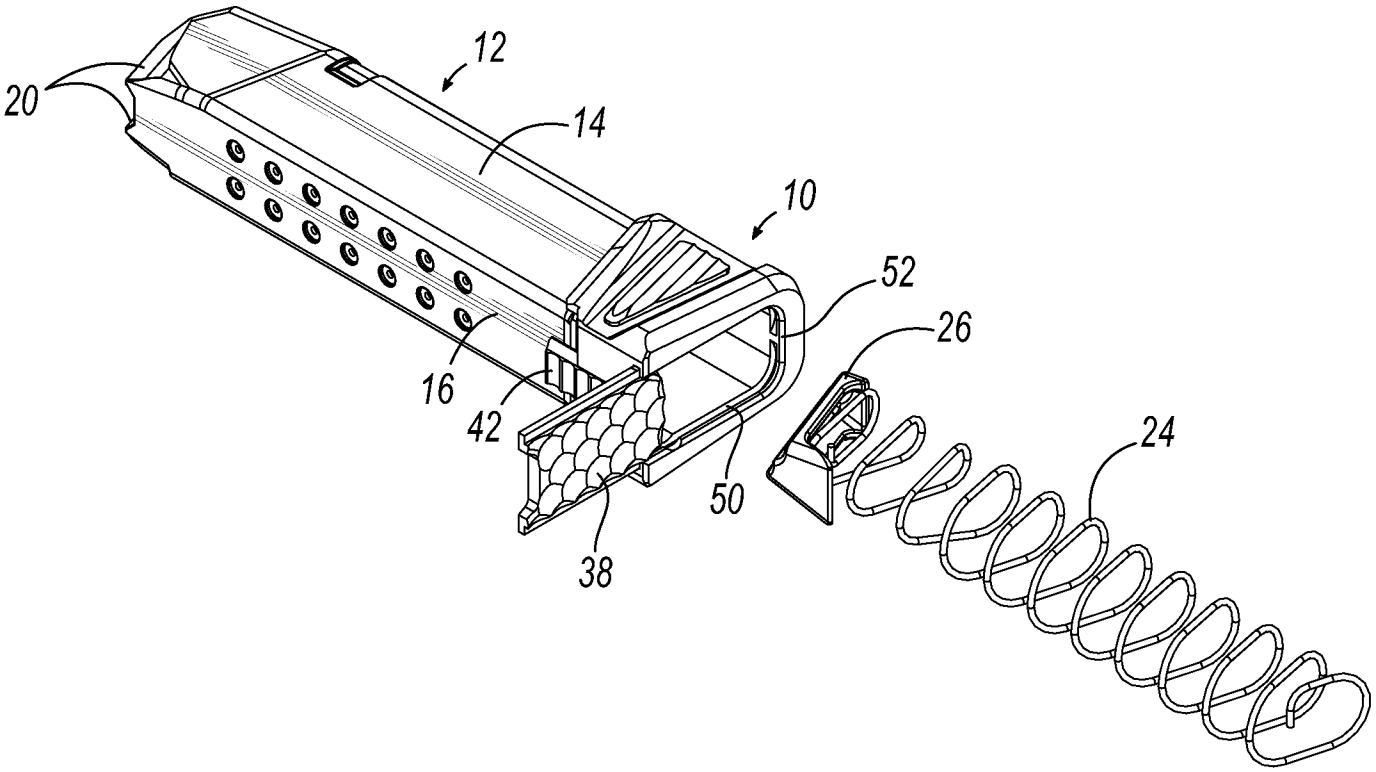
FIG. 10 is an isometric exploded view showing a magazine spring and follower being inserted into the open end of a magazine body to which a basepad extension according to an embodiment of the present invention has been installed.

A medial tooth 54 on the latch member 42 limits downward movement of the latch member when the bottom closure plate is installed and closed and acts as an abutment for the latch spring 48. However, before the bottom closure plate 38 is installed, the latch member 42 may be slid downwardly to allow assembly or disassembly of the basepad extension 10 to the magazine tube 12, as illustrated in FIGS. 7 and 8. As shown in FIG. 9, the latch member 42 may be slid upwardly, compressing the latch spring 48, to allow insertion of the bottom closure plate 38 into the side channels 50. A chamfer 56 on the forward edge of the bottom closure plate 38 and a chamfer 58 at the bottom end of the latch member 42 can facilitate this insertion of the plate 38 and displacement of the latch member 42. When the bottom closure plate 38 is partially advanced into the channels 50, it may be retained in an open position (shown in FIG. 11) by engagement of the bottom end of the latch member 42 into a notch 60 formed in the upper surface of the bottom closure plate 38. Pressure applied by the latch spring 48 against the tooth 54 maintains this engagement and retains the bottom closure plate 38 in the open position. As illustrated in FIG. 10, the spring 24 and follower 26 can be inserted or removed easily while the bottom closure plate 38 is retained in this position. Likewise, the interior chamber can be cleaned or lubricated without disassembly of the basepad extension 10 from the magazine tube 12, and without complete removal of the bottom closure plate 38.

Once the spring 24 and follower 26 have been inserted into the magazine tube 12 and basepad extension (as shown in FIG. 11), the bottom closure plate 38 may be slid closed position to hold the spring 24 in place. A rear edge of the notch 60 may include another chamfer surface 62 that, in cooperation with the bottom edge chamfer 58 of the latch member 42 will act as a cam as the bottom closure plate 38 is moved toward the closed position, slightly displacing the latch member 42. In contrast, flat surfaces on forward edges of the notch 60 and bottom end of the latch member 42 help detain the bottom closure plate 38 in the open position and prevent unintended separation of the parts. When the bottom closure plate 38 is moved to a fully closed position, the latch spring 48 will bias the latch member 42 into a latched position to keep the bottom closure plate 38 closed, as illustrated in FIG. 3. As previously described, the tooth 54 on the latch member 42 will contact an upper surface of the bottom closure plate 38 to limit movement of the latch member 42.

Alternatively, the latch member could be situated on the forward end wall 32 in an embodiment where the magazine tube 12 is slid into engagement from the front of the extension body 10. Likewise, the bottom closure plate could be inserted from the end opposite the latch member and be retained in a closed position by engagement of a leading edge with the latch member. In such an embodiment, the latch member would not detain the closure plate in the open position. In yet another alternative embodiment, the OEM baseplate could be used as the bottom closure plate for the extension 10.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An improved ammunition magazine extension for attachment to an open bottom of a magazine tube having a pair of sidewalls, a pair of end walls, and a flange on at least each of the sidewalls at the bottom, the extension comprising:

an extension body having open first and second ends and forward and rear walls, the first open end of the extension body slidably attachable to the sidewall flanges at the open bottom end of the ammunition magazine tube;

a bottom closure member removably slidably attached to the open second end of the body and movable between open and closed positions; and a latch member slidably attached to a wall of the extension body to move toward and away from the magazine tube and first and second ends of the extension body, the latch member releasably securing the extension body to the magazine tube when moved toward the magazine tube and the first open end of the extension body.

2. The magazine extension of claim 1, wherein the latch member is slidably attached to a wall of the extension body with a dovetail engagement.

3. The magazine extension of claim 1, wherein the latch member also releasably secures the bottom closure member in the open and closed positions.

4. The magazine extension of claim 3, wherein the latch member is spring biased away from the magazine tube and toward the bottom closure member.

5. The magazine extension of claim 4, wherein the sliding movement of the latch member away from the magazine tube and toward the open second end is limited by the bottom closure member when the bottom closure member is in the closed position.

6. The magazine extension of claim 3, wherein the bottom closure member includes a recess configured to receive an end portion of the latch member when the bottom closure member is in the open position, engagement of the latch member in the recess releasably retaining the closure member on the extension body in the open position.

7. The magazine extension of claim 6, wherein the latch member is spring biased away from the magazine tube and toward the bottom closure member.

8. The magazine extension of claim 4, wherein the latch member has an at rest position in which it is biased against the bottom closure member and secures the extension body to the magazine tube and, when the bottom closure member is removed from the extension body, the latch member can be moved away from the magazine tube and toward the open second end to allow slidable attachment and removal of the extension body to the magazine tube.

* * * * *